US008457542B2

(12) United States Patent
Wakimoto

(10) Patent No.: US 8,457,542 B2
(45) Date of Patent: Jun. 4, 2013

(54) IMAGE FORMING APPARATUS WITH WASTE TONER BOTTLE

(75) Inventor: Atsuhiro Wakimoto, Osaka (JP)

(73) Assignee: Kyocera Mita Corporation (JP)

( * ) Notice: Subject to any disclaimer, the term of this patent is extended or adjusted under 35 U.S.C. 154(b) by 178 days.

(21) Appl. No.: 13/214,297

(22) Filed: Aug. 22, 2011

(65) Prior Publication Data

US 2012/0051817 A1 Mar. 1, 2012

(30) Foreign Application Priority Data

Aug. 26, 2010 (JP) ..... 2010-189672

(51) Int. Cl.
*G03G 21/12* (2006.01)

(52) U.S. Cl.
USPC ..... 399/360

(58) Field of Classification Search
USPC ..... 399/120, 358, 359, 360
See application file for complete search history.

(56) References Cited

U.S. PATENT DOCUMENTS 8,401,434 B2 * 3/2013 Akaike ..... 399/258
2007/0223947 A1 9/2007 Ohkawa et al.

FOREIGN PATENT DOCUMENTS

JP 2005-77513 3/2005
JP 2007-86815 4/2007

* cited by examiner

*Primary Examiner* — Hoang Ngo
(74) *Attorney, Agent, or Firm* — Gerald E. Hespos; Michael J. Porco; Matthew T. Hespos

(57) ABSTRACT

An image forming apparatus includes an opening/closing mechanism for opening a lid member when a toner collecting portion including a waste toner bottle and the lid member for the waste toner bottle is mounted into an apparatus main body while closing the lid member when the toner collecting portion is removed from the apparatus main body. The opening/closing mechanism includes a first contact portion provided in a toner discharging portion for discharging toner for rotating the lid member in a first direction by coming into contact with the lid member when the toner collecting portion is mounted into the apparatus main body, and a second contact portion mounted in the apparatus main body for rotating the lid member in a second direction by coming into contact with the lid member when the toner collecting portion is removed from the apparatus main body.

7 Claims, 14 Drawing Sheets

IMAGE FORMING APPARATUS WITH WASTE TONER BOTTLE

BACKGROUND OF THE INVENTION

1. Field of the Invention

The present disclosure relates to an electrophotographic image forming apparatus with a waste toner bottle.

2. Description of the Related Art

An electrophotographic image forming apparatus such as a copier, a printer or a facsimile machine forms a toner image on an image bearing member (e.g. photoconductive drum) by supplying developer to an electrostatic latent image formed on the image bearing member to develop the electrostatic latent image. In an image forming apparatus according to this kind of conventional technology, toner not used for toner image formation is collected into a waste toner bottle.

In the image forming apparatus according to the conventional technology, when the waste toner bottle is removed from an apparatus main body, a discharge opening of a waste toner discharge duct is closed to prevent waste toner from leaking through the discharge opening to contaminate the interior of the apparatus main body. However, since the waste toner bottle is removed with an opening of the waste toner bottle kept open, the waste toner may leak from the waste toner bottle to contaminate a surrounding area if a user drops the waste toner bottle or brings the waste toner bottle into collision with the apparatus main body or the like by mistake upon removing the waste toner bottle.

SUMMARY OF THE INVENTION

An object of the present disclosure is to provide an image forming apparatus capable of preventing toner leakage when a waste toner bottle is removed.

In order to accomplish this object, one aspect of the present disclosure is directed to an image forming apparatus, including an apparatus main body; a processing unit arranged in the apparatus main body for performing an image forming process to form a toner image on a recording medium; a toner discharging portion arranged in the apparatus main body for discharging toner not used in the image forming process from the processing unit; a toner collecting portion, including a waste toner bottle for collecting the toner from the toner discharging portion and a lid member provided openably and closably with respect to the waste toner bottle, being removably mountable into the apparatus main body; and an opening/closing mechanism provided in the apparatus main body for opening the lid member of the toner collecting portion when the toner collecting portion is mounted into the apparatus main body while closing the lid member when the toner collecting portion is removed from the apparatus main body; wherein the lid member is set to an open state by rotating in a first direction and set to a closed state by rotating in a second direction opposite to the first direction; and the opening/closing mechanism includes a first contact portion provided at the toner discharging portion for rotating the lid member in the first direction by coming into contact with the lid member when the toner collecting portion is mounted into the apparatus main body, and a second contact portion mounted in the apparatus main body for rotating the lid member in the second direction by coming into contact with the lid member when the toner collecting portion is removed from the apparatus main body.

These and other objects, features and advantages of the present disclosure will become more apparent upon reading the following detailed description along with the accompanying drawings.

DETAILED DESCRIPTION OF THE PREFERRED EMBODIMENTS

Hereinafter, one embodiment according to the present disclosure is described with reference to the drawings. Note that direction-indicating terms such as "upper", "lower", "left" and "right" used in the following description are merely for clarifying the description and not of the nature to limit the present disclosure.

Figure 1A:
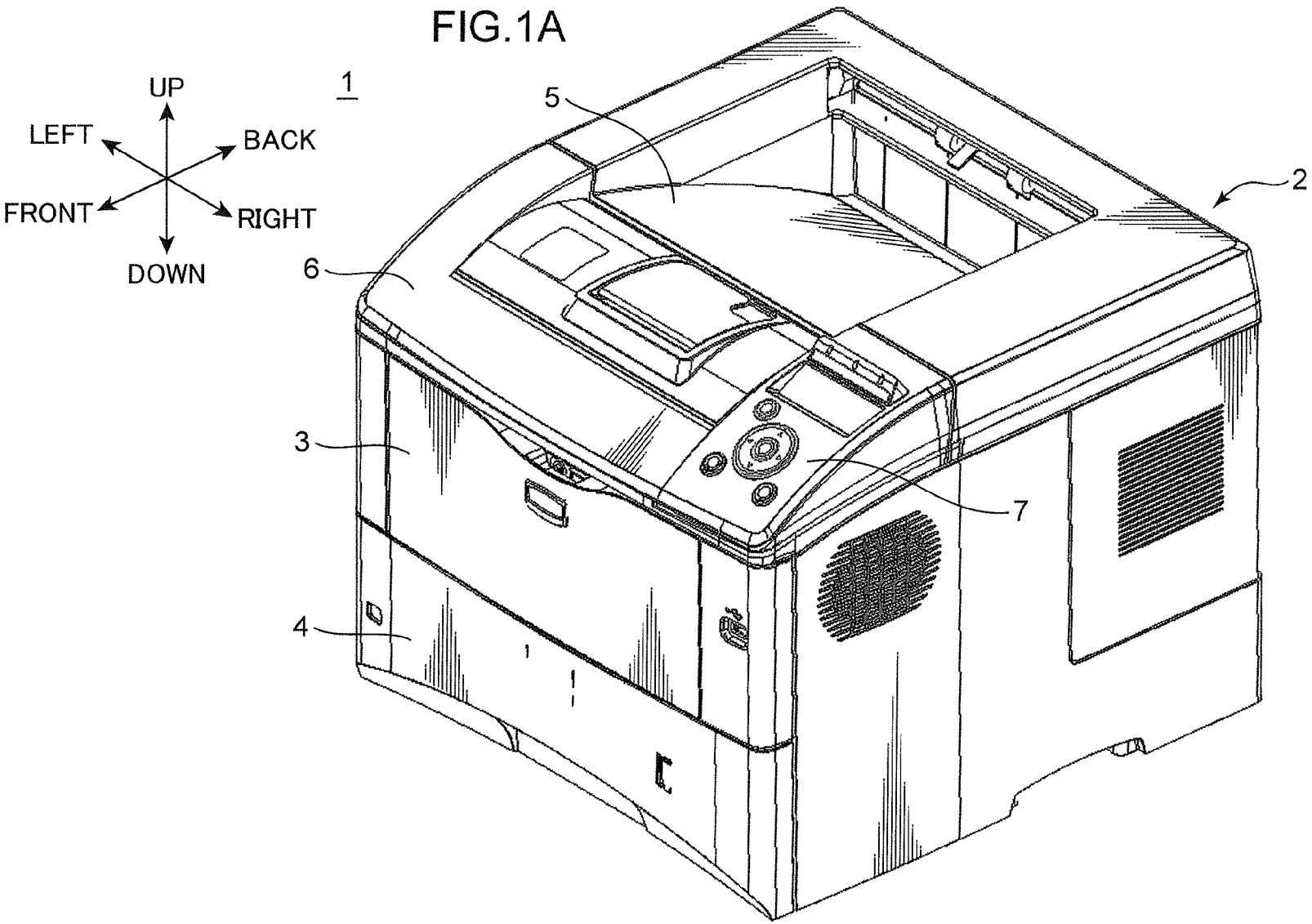
FIG. 1A is an external perspective view of an image forming apparatus according to one embodiment of the disclosure.
Figure 1B:
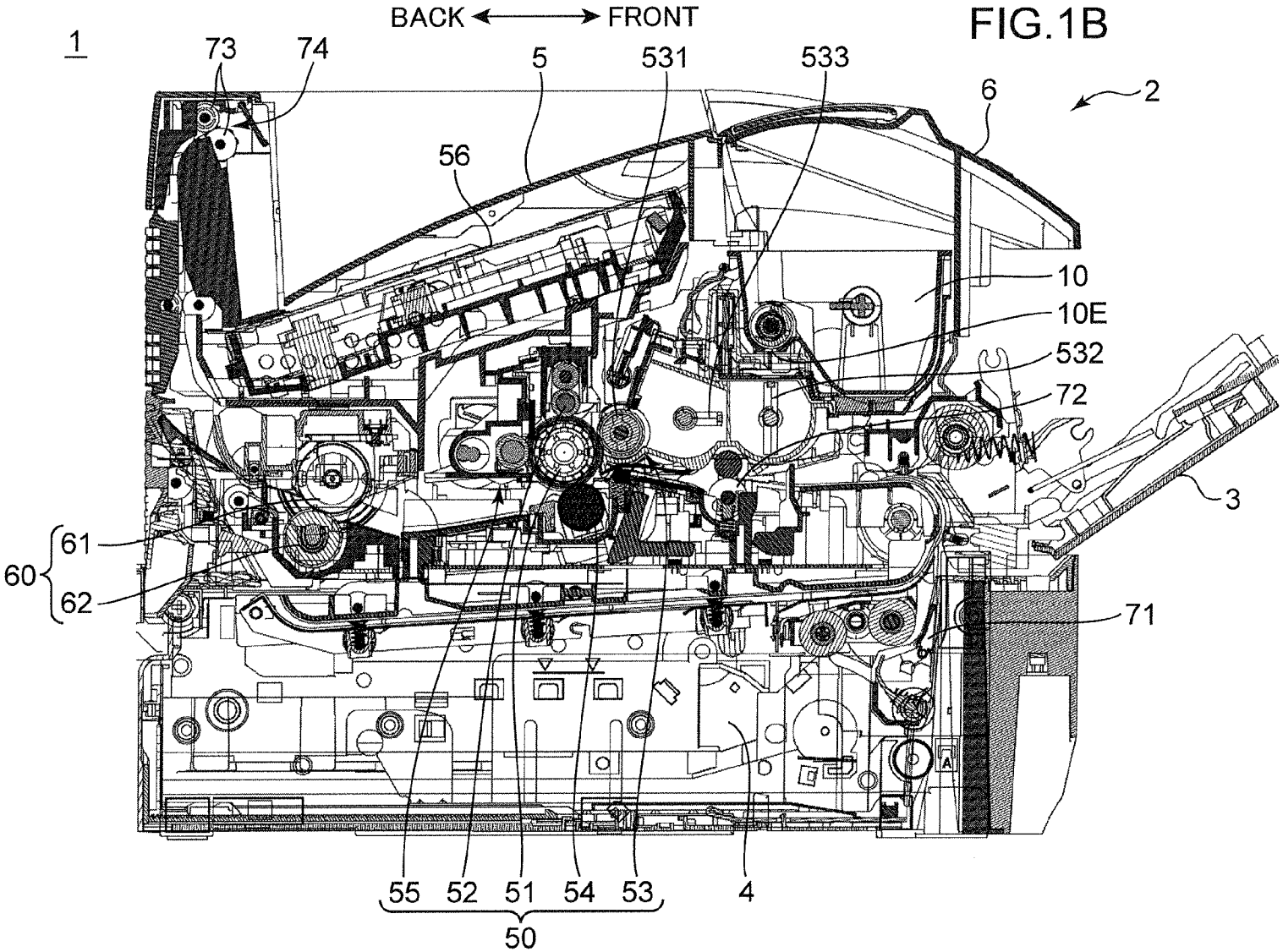
FIG. 1B is a sectional view of the image forming apparatus.

FIG. 1A is an external perspective view of an image forming apparatus 1 according to one embodiment of the present disclosure, and FIG. 1B is a sectional view of the image forming apparatus 1. Although the image forming apparatus 1 shown in FIGS. 1A and 1B is a printer, it may be a copier, a facsimile machine, multi-functional peripherals having these functions, or another apparatus capable of forming an image on a sheet in another embodiment. The image forming apparatus 1 includes a substantially rectangular parallelepipedic apparatus main body 2, a manual feed tray 3 openably and closably provided on the front side of the apparatus main body 2 and a sheet cassette 4 arranged below the manual feed tray 3.

A plurality of processing units (image forming unit 50 and fixing unit 60 to be described later) for performing an image forming process of forming a toner image on a sheet as an example of a recording medium are housed in the apparatus main body 2.

The manual feed tray 3 is mounted rotatably with respect to the apparatus main body 2 about the lower edge thereof. FIG. 1A shows a closed state of the manual feed tray 3. A user places desired sheet(s) on the manual feed tray 3 after rotating the manual feed tray 3 counterclockwise in FIG. 1A to set the manual feed tray 3 to an open state.

The sheet cassette 4 is removably mountable into the apparatus main body 2. The user pulls the sheet cassette 4 toward the front side (forward) from the apparatus main body 2 and stores sheets in the sheet cassette 4. The user inserts the sheet cassette 4 into the apparatus main body 2 after storing desired sheets in the sheet cassette 4. Sheets on the manual feed tray 3 and those in the sheet cassette 4 are fed toward the image forming unit 50 for forming an image on each sheet.

A discharge tray 5 is provided on the top surface of the apparatus main body 2. A sheet fed from the manual feed tray 3 or the sheet cassette 4 is discharged onto the discharge tray 5 after having a toner image formed thereon by the image forming unit 50. A substantially triangular prism-shaped space is formed above the discharge tray 5 and the sheets are stacked one over another in this space.

A top cover 6 is provided before the discharge tray 5 on the top surface of the apparatus main body 2. The top cover 6 is mounted openably and closably with respect to the top surface of the apparatus main body 2. The user can mount and remove a toner container 10 (FIG. 2) into and from the apparatus main body 2 by opening the top cover 6.

Figure 2:
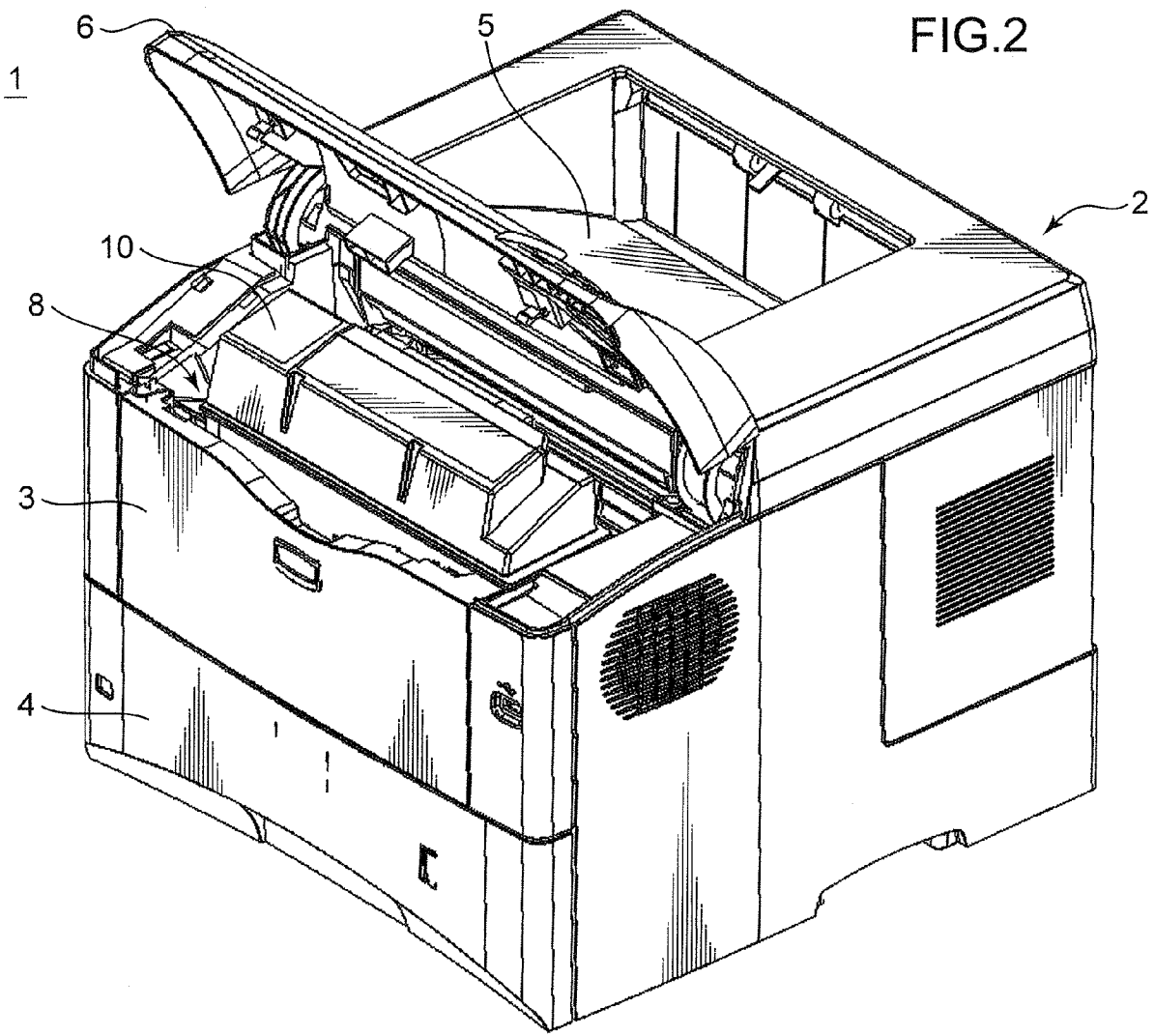
FIG. 2 is an external perspective view of the image forming apparatus showing a state where a top cover is open.

FIG. 2 is an external perspective view of the image forming apparatus 1 showing a state where the top cover 6 is open (open state). As shown in FIG. 2, the apparatus main body 2 includes a space 8 having such dimensions capable of housing the toner container 10 below the top cover 6. The toner container 10 is for supplying toner to a developing device 53 of the image forming unit 50 to be described later.

An operation panel 7 (see FIG. 1A) is arranged on the right side of the top cover 6. The user causes the image forming apparatus 1 to perform a desired operation by operating the operation panel 7. The image forming apparatus 1 forms a toner image on a sheet in accordance with an image signal (signal including information on an image to be printed) input by the user to the operation panel 7 or transmitted from an external apparatus (e.g. personal computer). Note that the operation panel 7 and the top cover 6 may be separate members.

With reference to FIG. 1B, the image forming unit 50 and the fixing unit 60 are provided as the processing units in the apparatus main body 2. The image forming unit 50 is for forming a toner image on a sheet fed from the manual feed tray 3 or the sheet cassette 4. The image forming unit 50 includes a photoconductive drum 51 forbearing an electrostatic latent image, a charger 52 for charging a surface of the photoconductive drum 51, an exposure device 56 for forming an electrostatic latent image corresponding to an image to be printed on the surface of the photoconductive drum 51 by means of a laser beam or the like, the developing device 53 for forming a toner image by attaching developer to the electrostatic latent image, a transfer roller 54 for transferring a toner image to a sheet, an unillustrated charge remover for removing electric charges on the surface of the photoconductive drum 51 after the transfer of a toner image, and a cleaner 55 for removing residual toner on the surface of the photoconductive drum 51.

The above-mentioned toner container 10 supplies toner into the developing device 53 through a toner discharge opening 10E. The developing device 53 includes a developing roller 531 for bearing and supplying toner to the photoconductive drum 51, and agitating members 532, 533 for conveying the toner while agitating it.

The fixing unit 60 includes a fixing roller 61 and a pressure roller 62. The fixing roller 61 includes a heat source inside. The pressure roller 62 is so arranged that the circumference surface thereof is in contact with that of the fixing roller 61, and forms a fixing nip portion in cooperation with the fixing roller 61. The fixing unit 60 fixes a toner image to a sheet having the toner image transferred thereto by heating and pressing the sheet while conveying the sheet nipped in the fixing nip portion.

For example, a sheet stored in the sheet cassette 4 is fed to a sheet conveyance path 71 in accordance with a print instruction. Thereafter, the sheet is temporarily stopped by a pair of registration rollers 72 and fed to the image forming unit 50 at a specified timing. When the sheet passes through a nip portion between the photoconductive drum 51 and the transfer roller 54, a toner image is transferred to the sheet. This toner image is fixed to the sheet when the sheet passes through the fixing nip portion of the fixing unit 60. Thereafter, the sheet is discharged to the discharge tray 5 through a discharge opening 74 of the apparatus main body 2 by a pair of discharge rollers 73.

Figure 3:
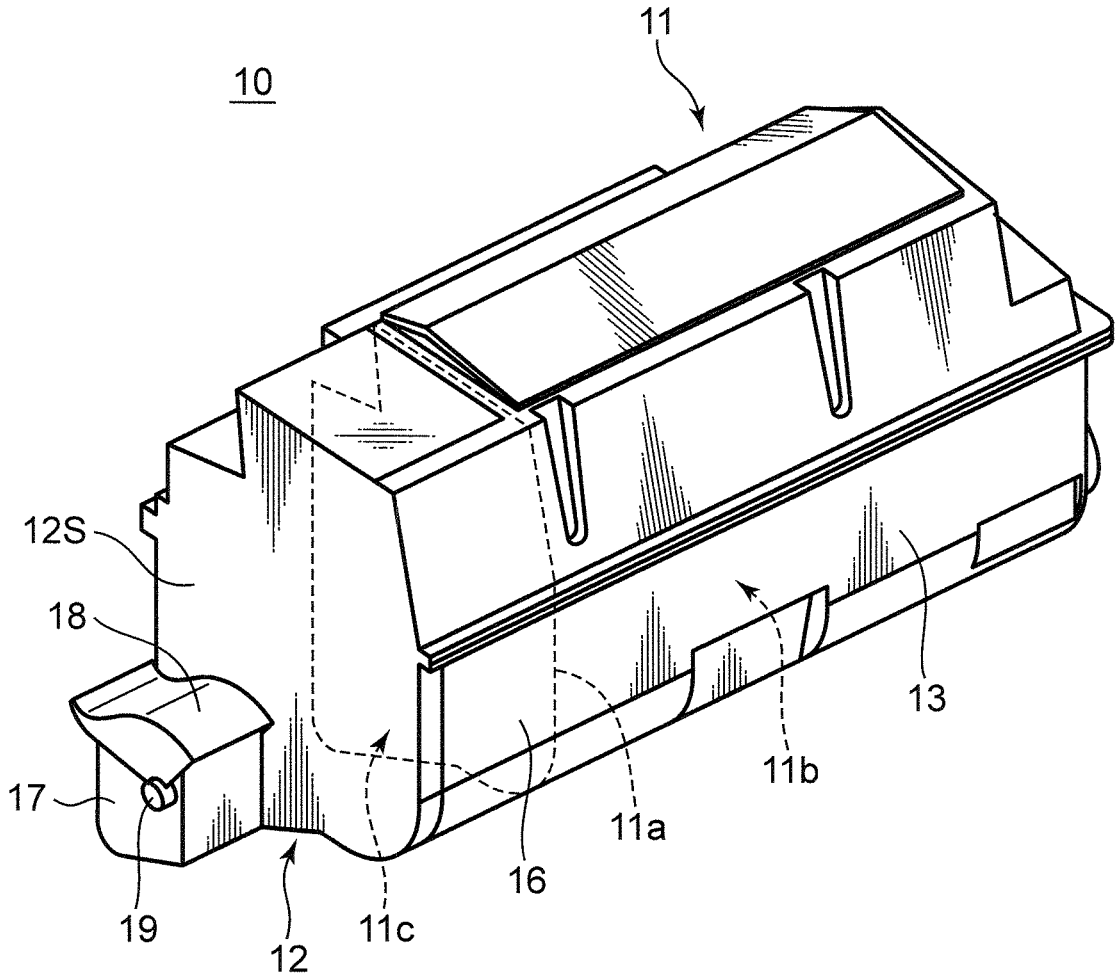
FIG. 3 is an external perspective view of a toner container.

FIG. 3 is an external perspective view of the toner container 10. In the image forming apparatus 1 constructed as described above, the toner container 10 is a container removably mountable into the apparatus main body 2 and used not only as a container for supplying the toner to the developing device 53 of the image forming unit 50, but also as a container for collecting the toner not used in an image forming process by the image forming unit 50 (out of the toner of the toner image formed on the surface of the photoconductive drum 51, the toner remained on the surface of the photoconductive drum 51 without being transferred to the sheet; hereinafter, referred to as "waste toner") from the image forming unit 50. The toner container 10 includes a container main body 11. The container main body 11 includes a supply toner containing portion 13 and a toner collecting portion 12.

The container main body 11 is in the form of a box extending from one side plate toward the other side plate of the apparatus main body 2 and two spaces 11*b*, 11*c* are defined by a partition wall 11*a* in the container main body 11. The supply toner containing portion 13 includes one space 11*b* and contains unused toner to be supplied to the developing device 53. The toner collecting portion 12 includes the other space 11*c* and contains the waste toner collected from the image forming unit 50.

Specifically, the toner collecting portion 12 includes a waste toner bottle 16, and the waste toner bottle 16 includes a waste toner inlet 17 and a lid member 18. The space 11*c* is a space in the waste toner bottle 16. The waste toner inlet 17 is a box-shaped container integrally provided to a side wall 12S in a longitudinal direction of the container main body 11, and the interior thereof communicates with the space 11*c* of the waste toner bottle 16. The waste toner inlet 17 includes a toner collection opening 171 (FIG. 7) which is open upward. The toner collection opening 171 is provided to collect the waste toner from a toner discharging portion 20 to be described later.

The lid member 18 is supported rotatably by a rotary shaft 19 arranged at the waste toner inlet 17 and openable and closable with respect to the toner collection opening 171. The lid member 18 rotates in a first direction about the rotary shaft 19 to be set to an open state to open the toner collection opening 171 when the toner container 10 is mounted into the apparatus main body 2. On the other hand, when the toner container 10 is removed from the apparatus main body 2, the lid member 18 rotates in a second direction opposite to the first direction about the rotary shaft 19 to be set to a closed state to close the toner collection opening 171. The lid member 18 is opened and closed not by the user, but by an opening/closing mechanism 30 (see FIG. 5) provided in the apparatus main body 2.

Figure 4:
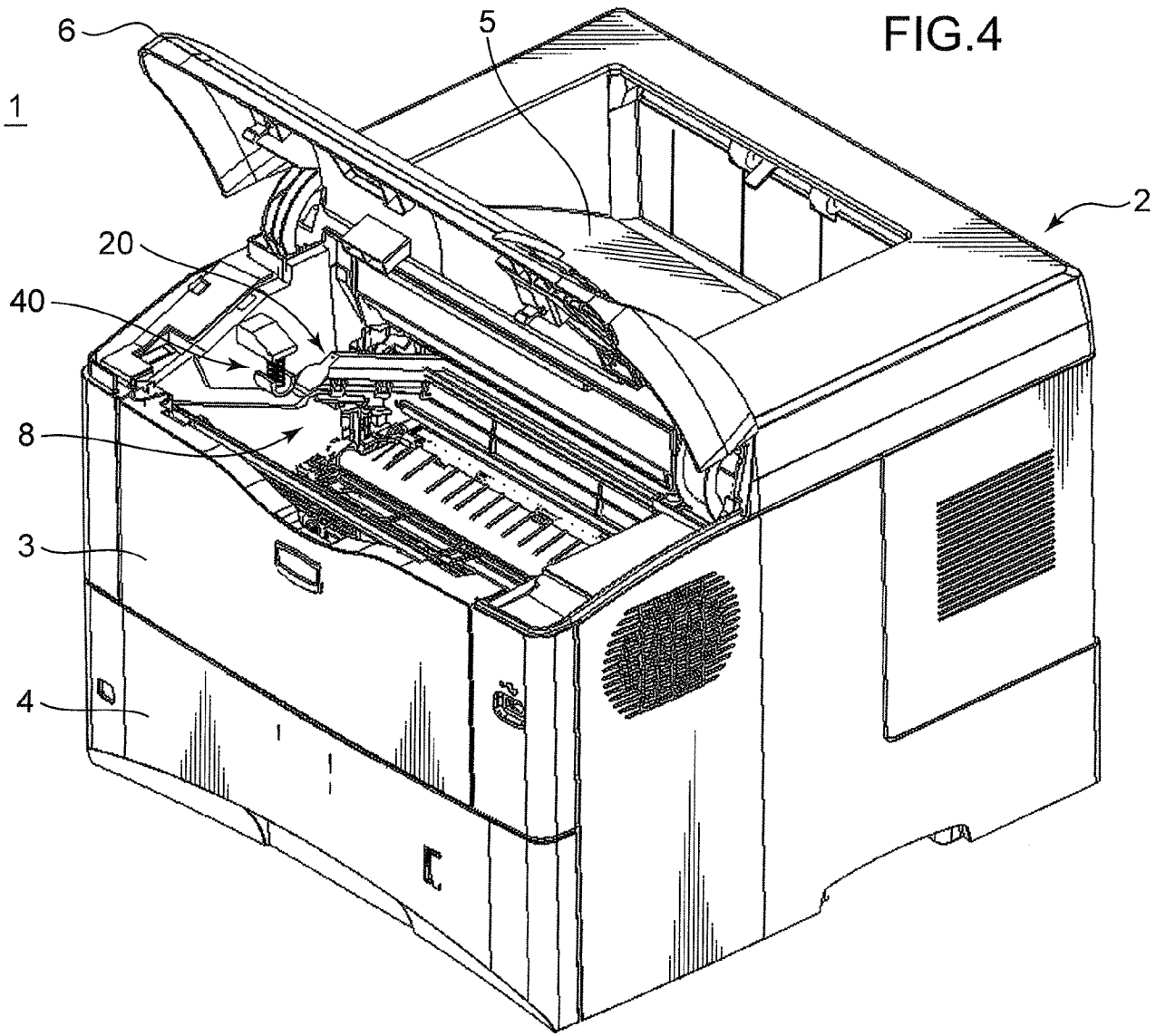
FIG. 4 is an external perspective view of the image forming apparatus showing a state where the top cover is open and the toner container is removed from an apparatus main body.
Figure 5:
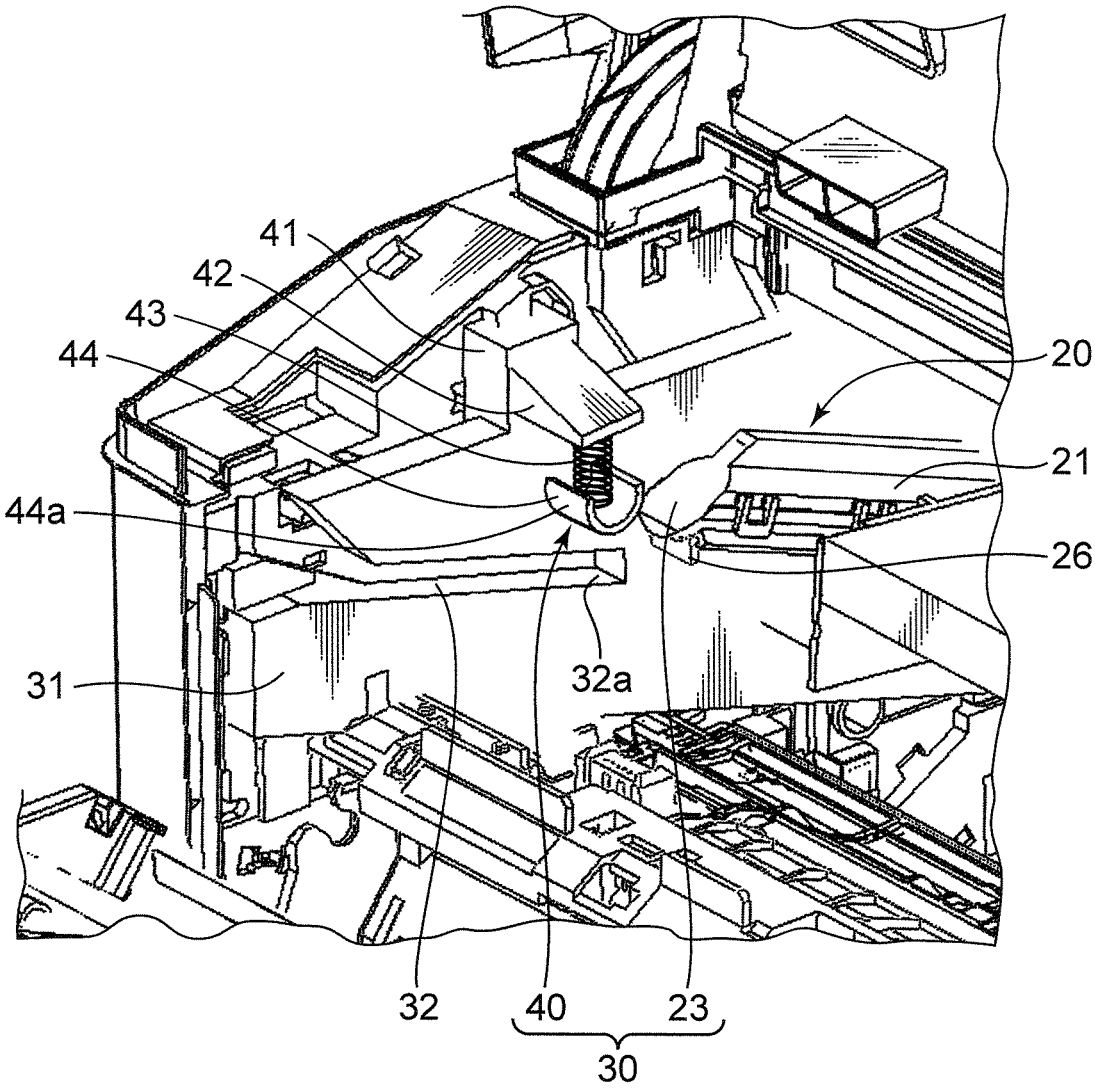
FIG. 5 is a partial enlarged perspective view of FIG. 4 showing an opening/closing mechanism.
Figure 6:
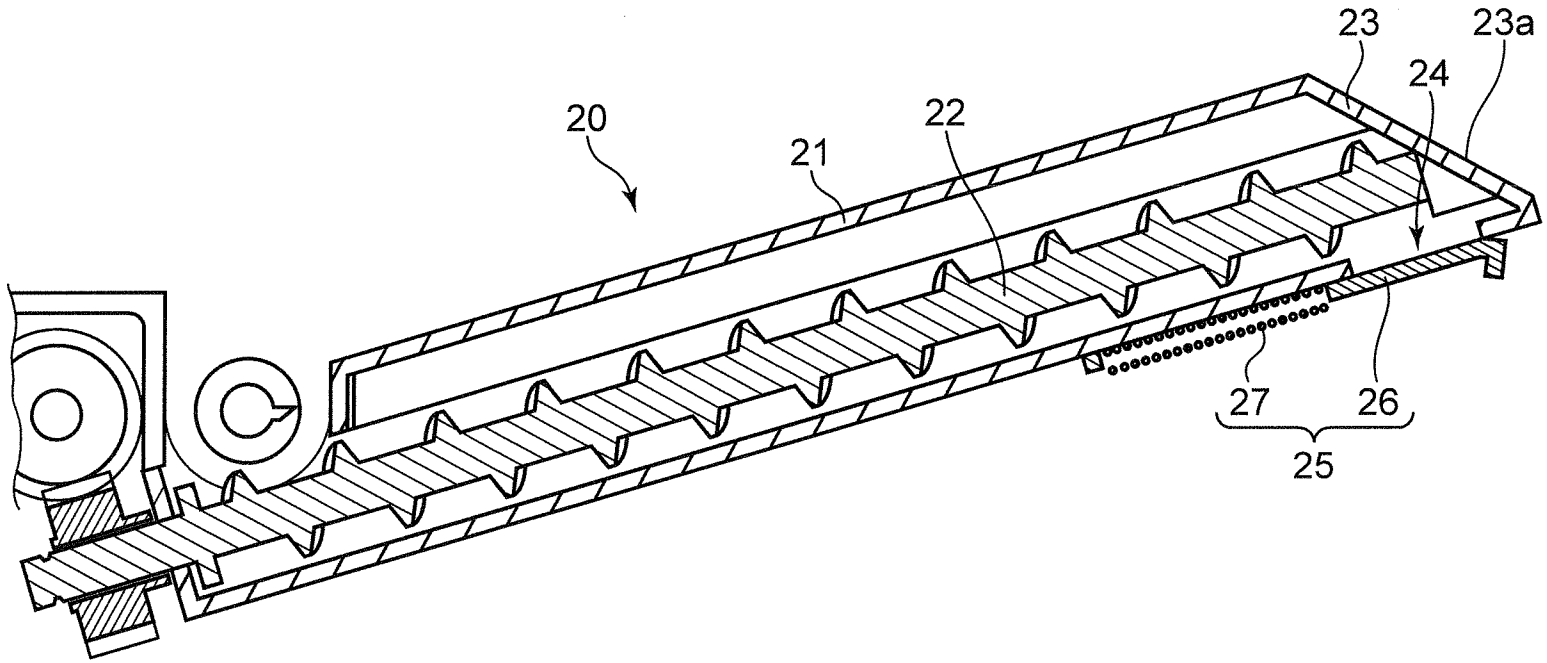
FIG. 6 is a longitudinal sectional view of a toner discharging portion.

The construction of the opening/closing mechanism 30 is described below with reference to FIGS. 4 to 6. FIG. 4 is an external perspective view of the image forming apparatus 1 showing a state where the top cover 6 is open and the toner container 10 is removed from the apparatus main body 2. FIG. 5 is a partial enlarged perspective view of FIG. 4 showing the opening/closing mechanism 30. FIG. 6 is a longitudinal sectional view of the toner discharging portion 20 constituting the opening/closing mechanism 30.

The opening/closing mechanism 30 includes a first contact portion 23 provided at the toner discharging portion 20 and a second contact portion 40 provided in the apparatus main body 2. The toner discharging portion 20 including the first contact portion 23 is arranged in the apparatus main body 2 to convey the waste toner from the image forming unit 50 to the toner collecting portion 12 of the toner container 10 and discharge the waste toner. The toner discharging portion 20 includes a housing 21, a conveying member 22 and a shutter mechanism 25.

The housing 21 is a tubular member and is shaped to extend from the image forming unit 50, specifically from the cleaner 55 of the image forming unit 50 toward the toner collecting portion 12 of the toner container 10 (conveyance path for the waste toner). A leading end portion of the housing 21 facing the toner container 10 includes an inclined portion. This inclined portion is such that a lower part thereof projects more toward the toner container 10 than an upper part thereof. In this embodiment, the inclined portion is used as the first contact portion 23. The first contact portion 23 opens the lid member 18 of the toner collecting portion 12 when the toner container 10 is mounted into the apparatus main body 2. A specific opening operation of the lid member 18 by the first contact portion 23 is described later. The shape of an inclined surface 23*a* of the first contact portion 23 is appropriately set according to the shape of the lid member 18 of the toner collecting portion 12.

The housing 21 also includes a toner discharge opening 24 for discharging the waste toner into the waste toner bottle 16. The toner discharge opening 24 is formed in a downward facing wall portion of the housing 21 near the first contact portion 23.

The conveying member 22 is arranged in the housing 21 and conveys the waste toner from the cleaner 55 of the image forming unit 50 to the toner discharge opening 24. The conveying member 22 is, for example, a screw member composed of a rotary shaft and a blade portion spirally provided on the outer circumferential surface of the rotary shaft. The structure of the conveying member 22 is not particularly limited.

The shutter mechanism 25 is arranged to open and close the toner discharge opening 24. The shutter mechanism 25 includes a slide plate 26 (shutter plate) and a spring member 27. The slide plate 26 is so dimensioned as to be able to completely cover the toner discharge opening 24 upon closing the toner discharge opening 24, and is slidable along a wall surface of the housing 21. That is, the slide plate 26 slides between a closing position for covering the toner discharge opening 24 and an open position for opening the toner discharge opening 24. The spring member 27 constantly biases the slide plate 26 in such a direction that the slide plate 26 closes the toner discharge opening 24. The shutter mechanism 25 opens the toner discharge opening 25 when the lid member 18 of the toner collecting portion 12 is set to the open state and closes the toner discharge opening 24 when the lid member 18 is set to the closed state. Opening and closing operations of the toner discharge opening 24 by the shutter mechanism 25 are described later.

The second contact portion 40 includes a contact plate 44, a spring member 43 (biasing member), a first supporting block 41 and a second supporting block 42.

The contact plate 44 is a member which comes into contact with the lid member 18 when the toner container 10 is mounted into and removed from the apparatus main body 2. The contact plate 44 is a semicylindrical body and has an arcuate contact surface.

The spring member 43 is a coil spring and has one end thereof fixed to the second supporting block 42 and the other end thereof fixed to the back surface of the contact plate 44 so as to be located between the contact plate 44 and the second supporting block 42. In this embodiment, the spring member 43 hangs down from the lower surface of the second supporting block 42 as shown in FIG. 5.

The first supporting block 41 is a member for supporting the second supporting block 42. The first supporting block 41 is fixed at a suitable position of a frame plate 31 attached to the inner surface of the side plate of the apparatus main body 2.

The frame plate 31 is formed with a guide groove 32 extending in a mounting direction of the toner container 10 into the apparatus main body 2. The toner container 10 is mounted into the apparatus main body 2 along the guide groove 32. A most downstream position of the guide groove 32 when viewed in the mounting direction of the toner container 10 is set as a mount position 32*a* of the toner container 10. When reaching the mount position 32*a*, the toner container 10 can supply the toner to the developing device 53 of the image forming unit 50 and collect the waste toner from the cleaner 55 of the image forming unit 50.

The second contact portion 40 constructed as described above is arranged upstream of the toner discharging portion 20, specifically the first contact portion 23 of the toner discharging portion 20 when viewed in the mounting direction of the toner container 10.

As described above, the contact plate 44 has the arcuate contact surface. The contact plate 44 is formed to be arcuate in the mounting direction of the toner container 10. Accordingly, an arcuate surface 44*a* of the contact plate 44 is facing in a perpendicular direction to the mounting direction of the toner container 10. A biasing direction of the contact plate 44 by the spring member 43 is also along this perpendicular direction.

The second contact portion 40 comes into contact with the lid member 18 of the toner collecting portion 12 and closes the lid member 18 by a biasing force thereof when the toner container 10 is removed from the apparatus main body 2. A closing operation of the lid member 18 by the second contact portion 40 is described later. In this embodiment, the lid member 18 is opened and closed by the opening/closing mechanism 30 including the two first and second contact portions 23, 40.

Figure 7:
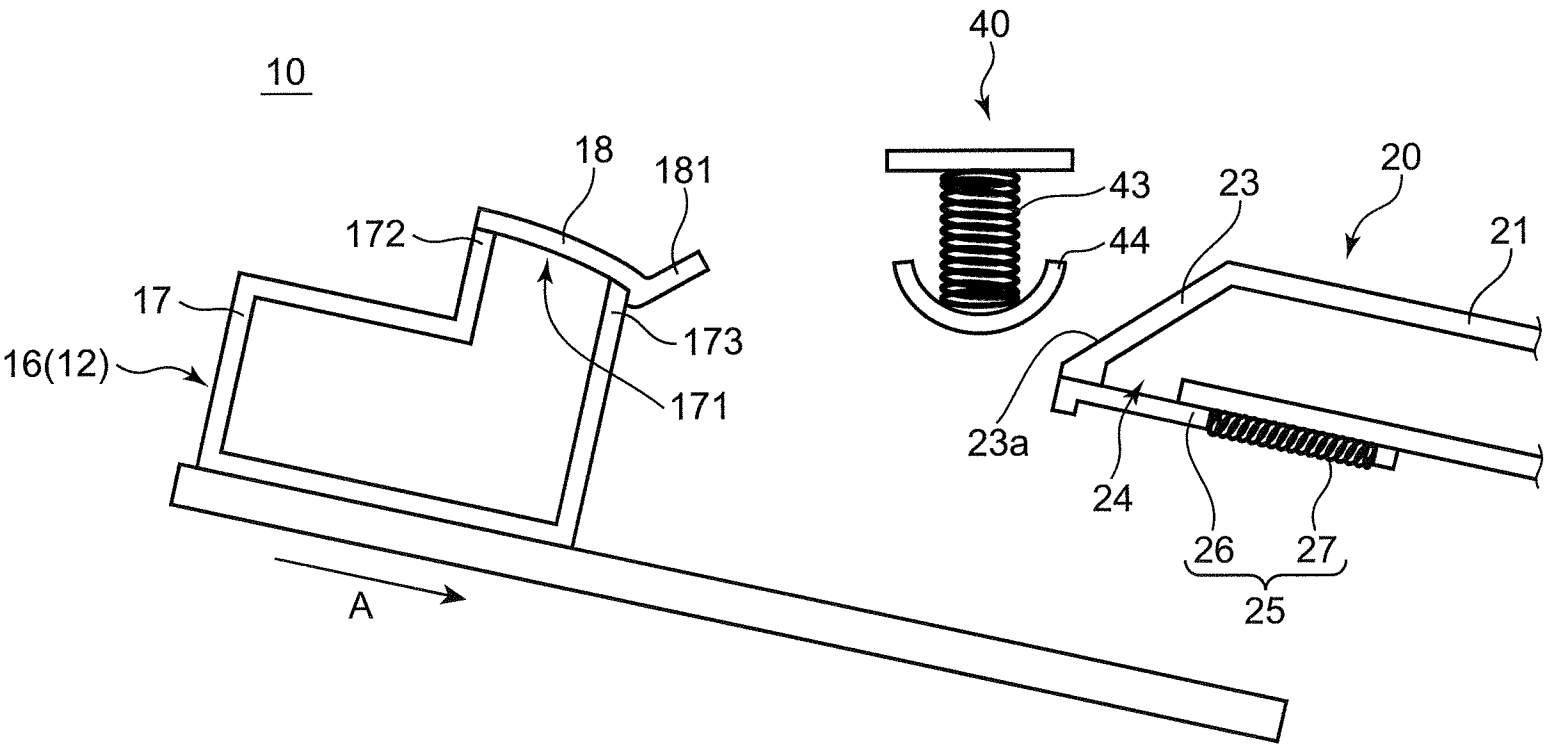
FIGS. 7 to 9 are diagrams showing an opening operation of a lid member by the opening/closing mechanism.
Figure 8:
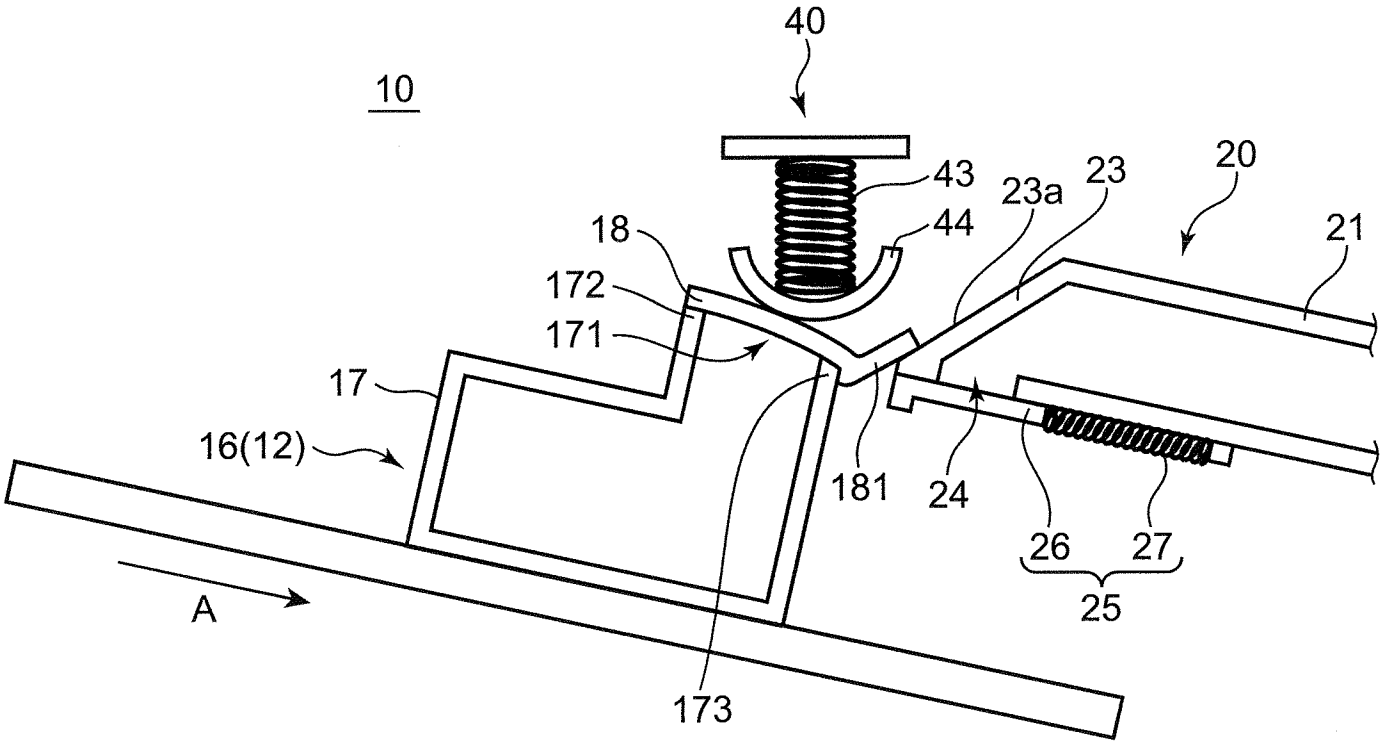
Figure 9:
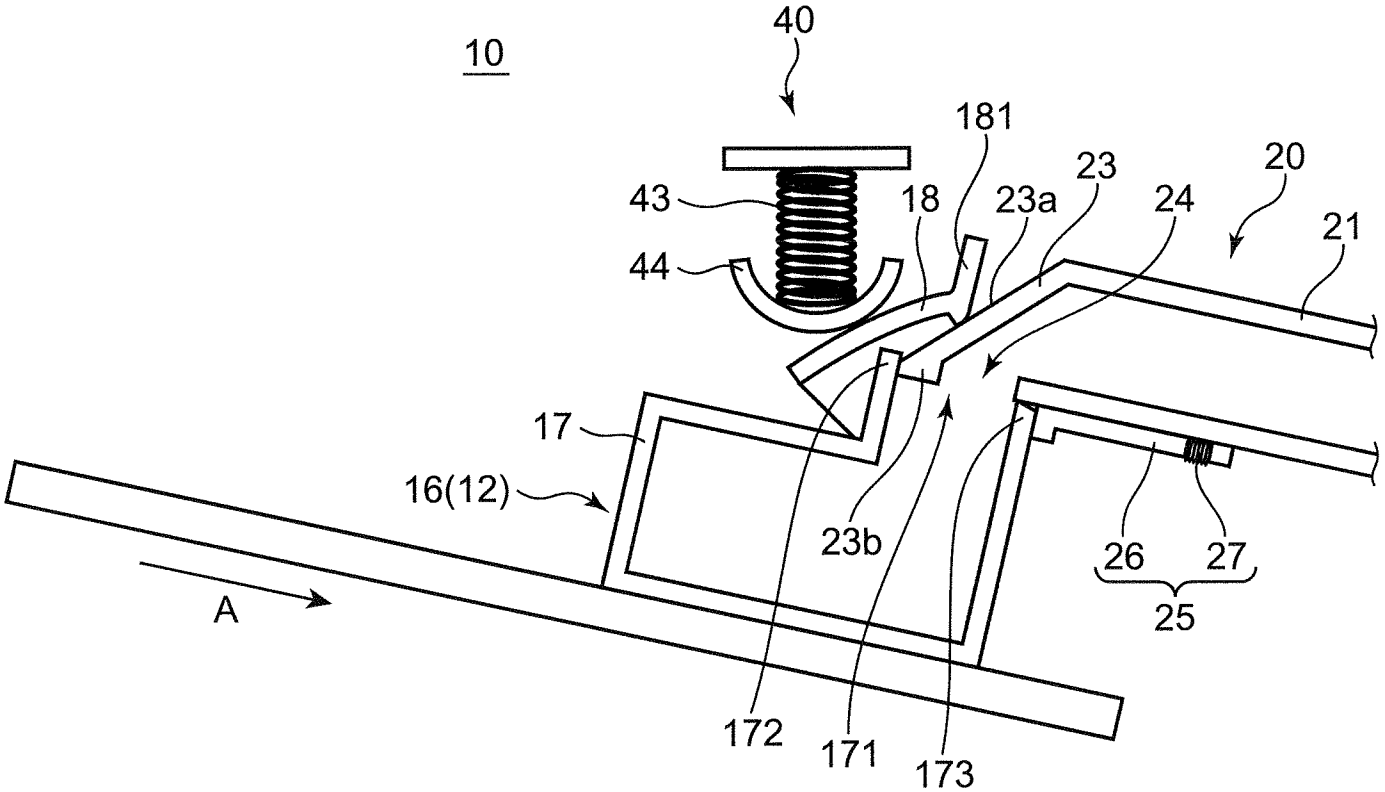
Figure 10:
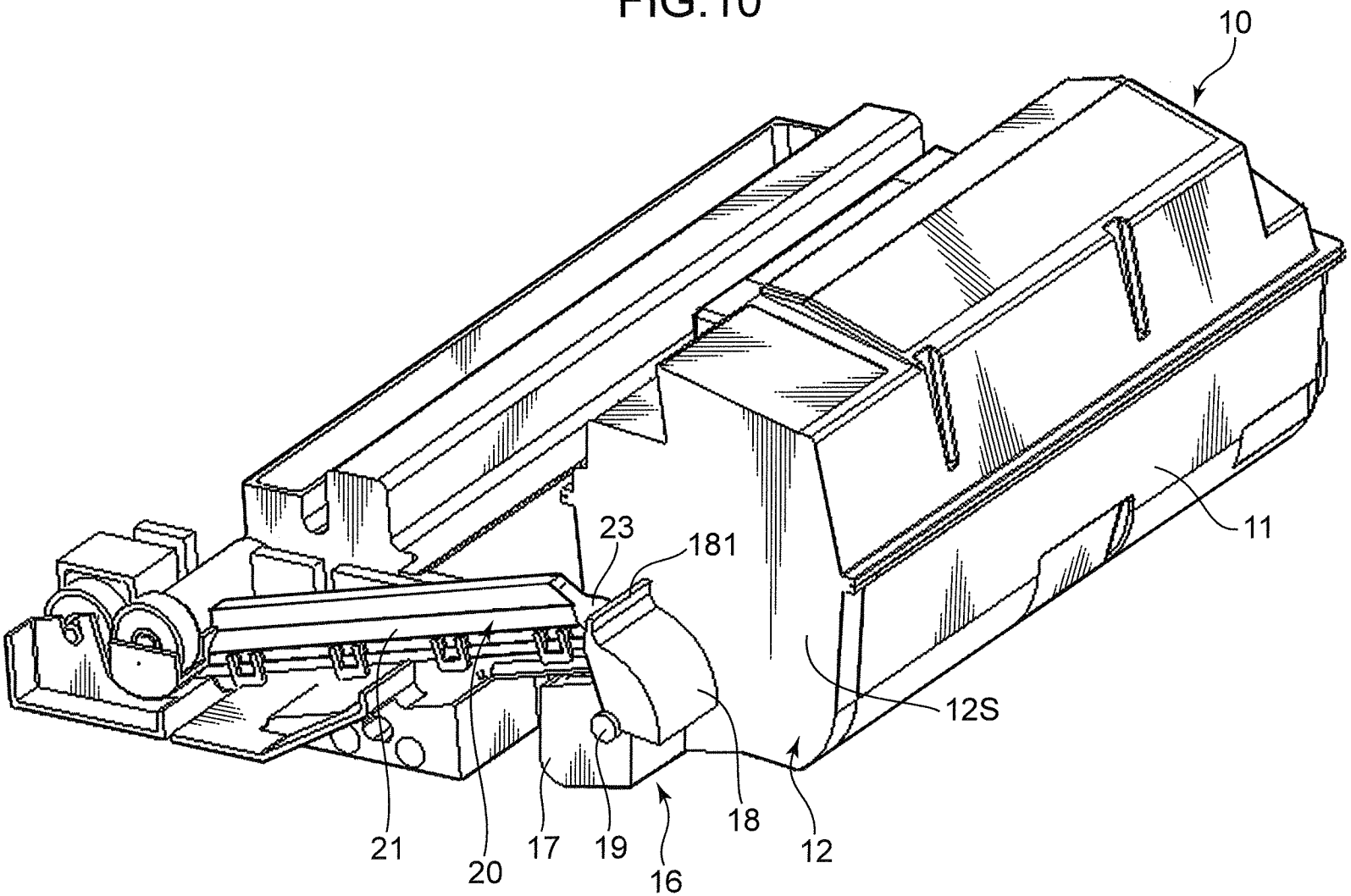
FIG. 10 is a perspective view showing a state where the toner container is mounted in the apparatus main body and the lid member is in an open state.
Figure 11:
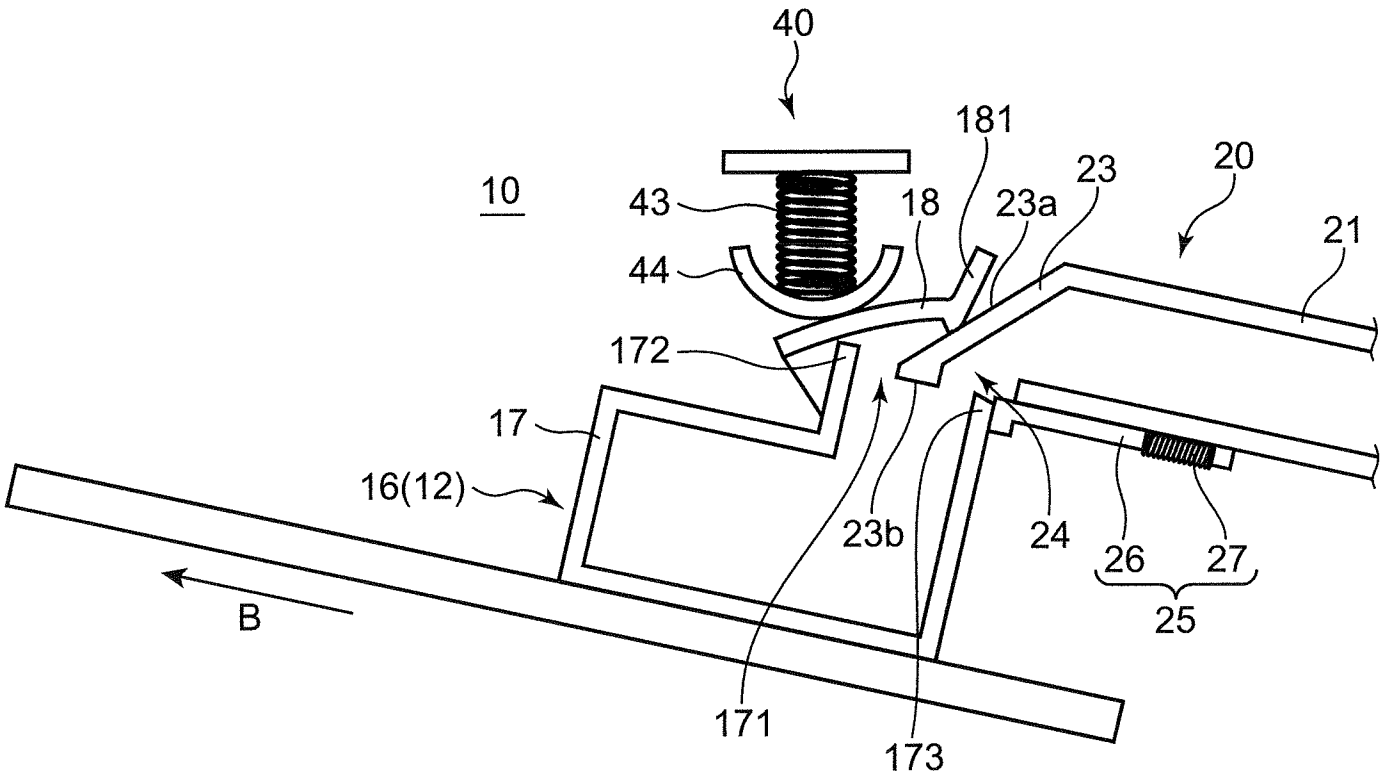
FIGS. 11 to 13 are diagrams showing a closing operation of the lid member by the opening/closing mechanism.
Figure 12:
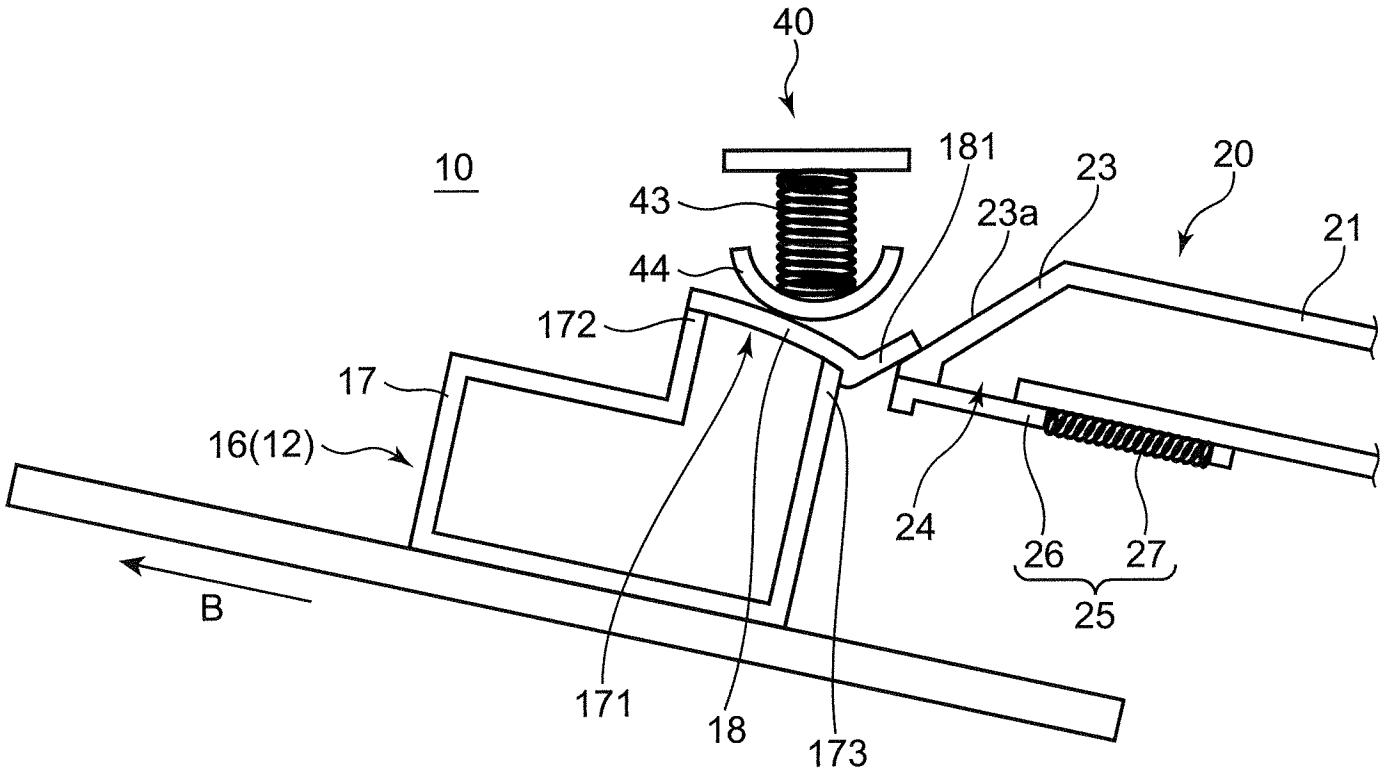
Figure 13:
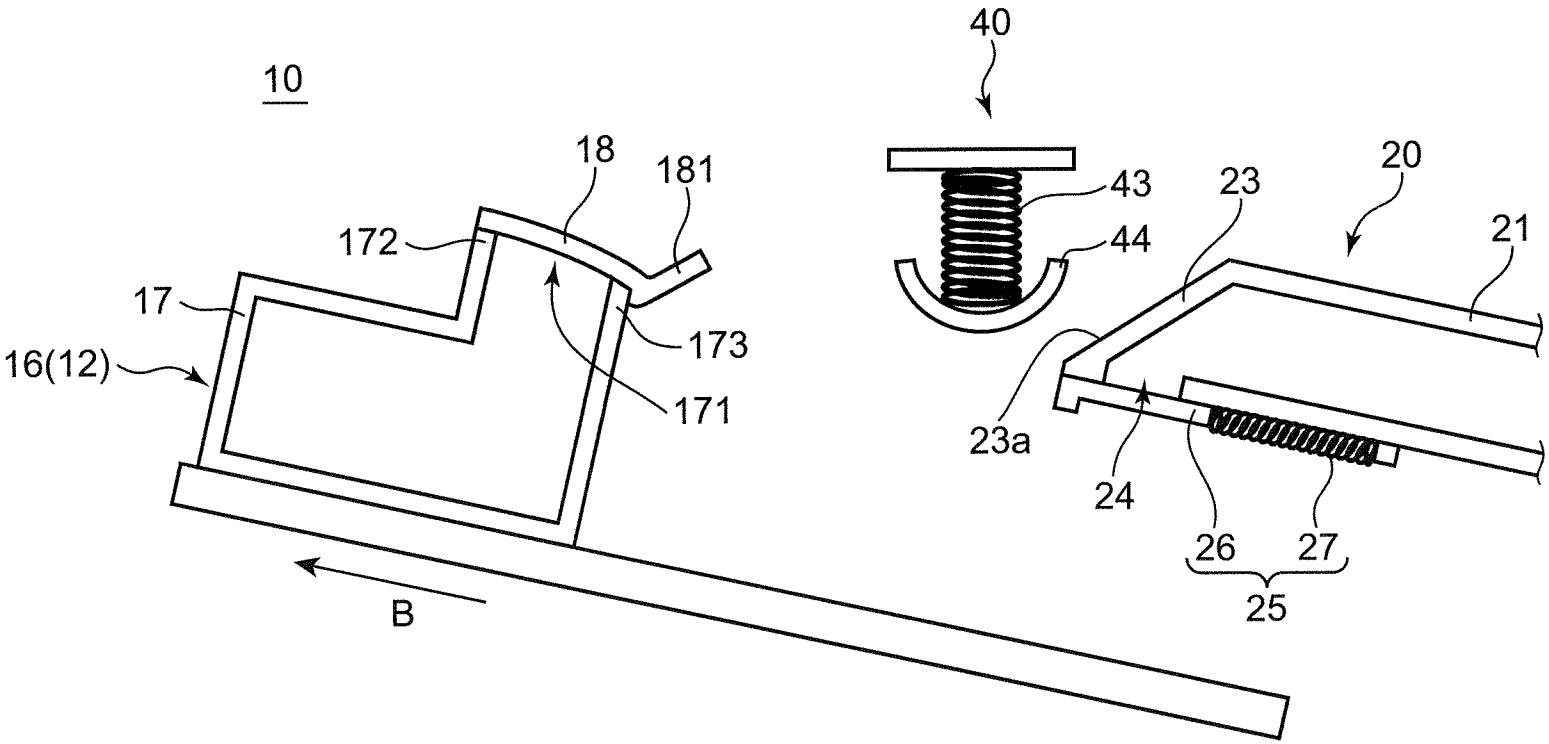

The opening and closing operations of the lid member 18 by the opening/closing mechanism 30 are described below with reference to FIGS. 7 to 13. FIGS. 7 to 9 are diagrams showing the opening operation of the lid member 18 by the opening/closing mechanism 30. FIG. 10 is a diagram showing a state where the toner container 10 is mounted in the apparatus main body 2 and the lid member 18 is in the open state. FIGS. 11 to 13 are diagrams showing the closing operation of the lid member 18 by the opening/closing mechanism 30.

First, the opening operation of the lid member 18 by the opening/closing mechanism 30 is described with reference to FIGS. 7 to 9. As shown in FIG. 7, the lid member 18 is in the closed state when the toner container 10 is mounted into the apparatus main body 2 along a mounting direction A by the user. As the toner container 10 moves toward the mount position 32*a* (FIG. 5) along the mounting direction A, the contact plate 44 of the second contact portion 40 first comes into contact with a leading end portion 181 of the lid member 18 from a downstream side in the mounting direction A. As shown in FIGS. 7 and 8, the leading end portion 181 is shaped to project obliquely upward to the right from a main part of the lid member 18. As the toner container 10 (i.e. toner collecting portion 12) further moves forward, the contact plate 44 comes into contact with the upper surface of the lid member 18 as shown in FIG. 8. At this time, the second contact portion 40 is in a first state to apply a biasing force to the lid member 18 by a biasing force of the spring member 43 and the contact plate 44 presses the lid member 18 from above. Thus, the lid member 18 is kept in the closed state. As shown in FIG. 8, although the inclined surface 23*a* of the first contact portion 23 is in contact with the leading end portion 181 of the lid member 18 in FIG. 8, the leading end portion 181 is not subject to any force from the first contact portion 23 at this time.

However, when the toner container 10 moves toward a further downstream side in the mounting direction A from the state shown in FIG. 8, the leading end portion 181 of the lid member 18 is pressed against the inclined surface 23*a* of the first contact portion 23 by the user's force to press the toner container 10 into the apparatus main body 2. In this way, the lid member 18 starts rotating counterclockwise (first direction) in FIG. 8 against the biasing force of the spring member 43 of the second contact portion 40.

The waste toner inlet 17 of the waste toner bottle 16 includes a first opening edge portion 172 and a second opening edge portion 173 defining the toner collection opening 171. The first and second opening edge portions 172, 173 are parts of a continuous opening edge portion, which is separated into the first opening edge portion 172 located at an upstream side and the second opening edge portion 173 located at a downstream side when viewed in the mounting direction A in order to facilitate the description.

When the toner container 10 further moves along the mounting direction A, the leading end portion 181 of the lid member 18 slides upward on the inclined surface 23*a* of the first contact portion 23 and a lower part 23*b* of the first contact portion 23 comes into contact with the first opening edge portion 172 of the waste toner bottle 16 from the downstream side in the mounting direction A. In this way, the lid member 18 is set in the open state as shown in FIGS. 9 and 10. That is, the lid member 18 rotates in the first direction to be retracted toward the side of the first opening edge portion 172 to open the side of the second opening edge portion 173.

Further, when the leading end portion 181 of the lid member 18 slides upward on the inclined surface 23*a*, the slide plate 26 of the shutter mechanism 25 of the toner discharging portion 20 comes into contact with the second opening edge portion 173 (part of the toner collecting portion) of the waste toner inlet 17 from the downstream side in the mounting direction A. Since this causes the slide plate 26 to slide against the biasing force of the spring member 27, the toner discharge opening 24 of the toner discharging portion 20 is opened. Thus, the toner discharge opening 24 of the toner discharging portion 20 and the toner collection opening 171 of the waste toner inlet 17 come to be connected and the toner collecting portion 12 can collect the waste toner from the toner discharging portion 20.

The mount position 32*a* (FIG. 5) of the toner container 10 is set such that the lower part 23*b* of the first contact portion 23 is in contact with the first opening edge portion 172 of the waste toner inlet 17 and the lid member 18 is in the open state. The second contact portion 40 is located upstream of the lid member 18 in the mounting direction A when the toner container 10 reaches the mount position 32*a* and the lid member 18 is set in the open state. At this time, the second contact portion 40 is in a second state to stop applying a biasing force to the lid member 18.

Next, the closing operation of the lid member 18 by the opening/closing mechanism 30 is described with reference to FIGS. 11 to 13. When the user removes the toner container 10 from the apparatus main body 2 for replacement of the toner container 10, the toner collecting portion 12 moves along a removing direction B as shown in FIG. 11. Thus, the first opening edge portion 172 of the waste toner inlet 17 is separated from the lower part 23*b* of the first contact portion 23 and the leading end portion 181 of the lid member 18 slides downward on the inclined surface 23*a* of the first contact portion 23. At this time, the second contact portion 40 comes into contact with the lid member 18. Specifically, the spring member 43 of the second contact portion 40 applies a biasing force (pressing force) to rotate the lid member 18 in a second direction (clockwise direction in FIG. 11) opposite to the first direction and the contact plate 44 presses the lid member 18 from above.

Thus, as shown in FIG. 12, the lid member 18 is set in the closed state by the second contact portion 40 to close the toner collection opening 171 of the waste toner inlet 17 when the leading end portion 181 of the lid member 18 is separated from the lower part 23*b* of the first contact portion 23, i.e. when the leading end portion 181 of the lid member 18 no longer receives a contact force from the first contact portion 23.

Further, as shown in FIG. 11, as the second opening edge portion 173 of the waste toner inlet 17 moves in the removing direction B according to a movement of the toner collecting portion 12 (waste toner bottle 16) in the removing direction B, the slide plate 26 of the shutter mechanism 25 is biased by the spring member 27 to move in such a direction as to close the toner discharge opening 24. Thus, the slide plate 26 can completely close the toner discharge opening 24 as shown in FIG. 12 at a timing when the second opening edge portion 173 is separated from the slide plate 26.

As shown in FIG. 13, the toner collecting portion 12 (i.e. toner container 10) is removed from the apparatus main body 2 with the lid member 18 kept in the closed state when further moving in the removing direction B from the state shown in FIG. 12.

According to the image forming apparatus 1 of this embodiment described above, the opening/closing mechanism 30 for opening and closing the lid member 18 of the toner collecting portion 12 closes the lid member 18 when the toner collecting portion 12 (waste toner bottle 16) is removed from the apparatus main body 2. Thus, the toner collection opening 171 is closed. As a result, leakage of the toner through the toner collection opening 171 and contamination of a surrounding area thereby are prevented. Further, in the image forming apparatus 1 according to this embodiment, the opening/closing mechanism 30 is provided not in the toner collecting portion 12, but in the apparatus main body 2. Thus, if the toner collecting portion 12 is an exchangeable disposable part, the number of members to be discarded can be reduced and resulting cost saving is achieved as compared with a construction in which an opening/closing mechanism is provided in the toner collecting portion 12.

Further, according to the image forming apparatus 1 of this embodiment, the lid member 18 can be opened and closed by simple operations of bringing the two first and second contact portions 23, 40 into contact with the lid member 18.

Further, according to the image forming apparatus 1 of this embodiment, the lid member 18 can be rotated in the second direction to close the toner collection opening 171 by a simple operation of applying a biasing force to the lid member 18 by the spring member 43 of the second contact portion 40.

Further, according to the image forming apparatus 1 of this embodiment, a biasing force is applied to the lid member 18 by the spring 43 when the second contact portion 40 is in the first state. Thus, the user can feel the biasing force applied to the lid member 18 when the toner collecting portion 12 is moving toward the mount position 32*a*. Further, since the second contact portion 40 stops applying the biasing force to the lid member 18 when being in the second state, the user can feel the arrival of the toner collecting portion 12 at the mount position 32*a*. In this way, the user feels a change in the biasing force to the lid member 18 from the spring member 43 of the second contact portion 40, thereby being able to know whether or not the toner collecting portion 12 has reached the mount position 32*a*.

Further, according to the image forming apparatus 1 of this embodiment, the shutter mechanism 25 provided in the toner discharging portion 20 closes the toner discharge opening 24 with the slide plate 26 utilizing the biasing force of the spring member 27 when the lid member 18 is set in the closed state to close the toner collection opening 171. This prevents the toner from leaking through the toner discharge opening 24 to contaminate the interior of the apparatus main body 2 when the toner collecting portion 12 is separated from the toner discharging portion 20 and removed from the apparatus main body 2.

This application is based on Japanese Patent application No. 2010-189672 filed in Japan Patent Office on Aug. 26, 2010, the contents of which are hereby incorporated by reference.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus, comprising:

an apparatus main body;

a processing unit arranged in the apparatus main body for performing an image forming process to form a toner image on a recording medium;

a toner discharging portion arranged in the apparatus main body for discharging toner not used in the image forming process from the processing unit;

a toner collecting portion, including a waste toner bottle for collecting the toner from the toner discharging portion and a lid member provided openably and closably with respect to the waste toner bottle, and being removably mountable into the apparatus main body; and an opening/closing mechanism provided in the apparatus main body for opening the lid member of the toner collecting portion when the toner collecting portion is mounted into the apparatus main body while closing the lid member when the toner collecting portion is removed from the apparatus main body; wherein:

the lid member is set to an open state by rotating in a first direction and set to a closed state by rotating in a second direction opposite to the first direction; and the opening/closing mechanism includes:

a first contact portion provided at the toner discharging portion for rotating the lid member in the first direction by coming into contact with the lid member when the toner collecting portion is mounted into the apparatus main body, and a second contact portion mounted in the apparatus main body for rotating the lid member in the second direction by coming into contact with the lid member when the toner collecting portion is removed from the apparatus main body.

2. An image forming apparatus according to claim 1, wherein:

the second contact portion includes a biasing member for applying a biasing force to the lid member to rotate the lid member in the second direction.

3. An image forming apparatus according to claim 2, wherein:

the second contact portion is a member located upstream of the first contact portion when viewed in a mounting direction in which the toner collecting portion is mounted to a mount position in the apparatus main body, and is set to a first state to apply the biasing force to the lid member by coming into contact with the lid member from a downstream side in the mounting direction when the toner collecting portion is moving toward the mount position while being located upstream of the lid member when viewed in the mounting direction and set to a second state to stop applying the biasing force to the lid member when the toner collecting portion reaches the mount position.

4. An image forming apparatus according to claim 1, wherein:

the toner discharging portion includes a toner discharge opening for discharging the toner and a shutter mechanism for opening and closing the toner discharge opening; and the shutter mechanism opens the toner discharge opening when the lid member is set to the open state while closing the toner discharge opening when the lid member is set to the closed state.

5. An image forming apparatus according to claim 4, wherein:

the shutter mechanism includes a shutter plate which slides between a closed position for covering the toner discharge opening and an open position for opening the toner discharge opening and a spring member for biasing the shutter plate toward the closed position; and the shutter plate comes into contact with a part of the toner collecting portion to be displaced from the closed position to the open position when the lid member is set to the open state.

6. An image forming apparatus according to claim 1, wherein:

the waste toner bottle includes a waste toner inlet with a toner collection opening;

the waste toner inlet includes a first opening edge portion and a second opening edge portion defining the toner collection opening, the second opening edge portion being located downstream of the first opening edge portion when viewed in the mounting direction of the toner collecting portion into the apparatus main body; and the lid member is supported rotatably about a rotary shaft arranged at the waste toner inlet and retracted toward the side of the first opening edge portion to open the side of the second opening edge portion by rotating in the first direction.

7. An image forming apparatus according to claim 1, wherein:

the toner discharging portion includes a housing serving as a path for conveying toner and a toner discharge opening provided at a leading end of the housing for discharging the toner into the waste toner bottle;

the first contact portion is an inclined surface provided at the leading end of the housing;

the lid member is rotated in the first direction by the leading end of the lid member sliding on the inclined surface when the toner collecting portion is mounted into the apparatus main body; and the lid member is rotated in the second direction by the second contact portion applying a pressing force to the lid member when the toner collecting portion is removed from the toner collecting portion.

* * * * *